US006168086B1

(12) United States Patent
Tanenbaum

(10) Patent No.: US 6,168,086 B1
(45) Date of Patent: Jan. 2, 2001

(54) DEHUMIDIFIER

(76) Inventor: Aaron Tanenbaum, 5385 Peachtree-Dunwoody Rd., Apt. 216, Atlanta, GA (US) 30342

( * ) Notice: Under 35 U.S.C. 154(b), the term of this patent shall be extended for 0 days.

(21) Appl. No.: 09/273,892

(22) Filed: Mar. 22, 1999

(51) Int. Cl.[7] ..... F24D 3/08; F25D 17/06
(52) U.S. Cl. ..... 237/19; 62/89; 62/93
(58) Field of Search ..... 237/19; 62/89, 62/93

(56) References Cited

U.S. PATENT DOCUMENTS 3,844,338 * 10/1974 Hilgemann et al. ..... 165/3
4,360,152 * 11/1982 Schlatter et al. ..... 237/19 X
5,039,007 * 8/1991 Wolter ..... 237/19 X
5,076,494 * 12/1991 Ripka ..... 237/19
5,687,908 * 11/1997 Talbert et al. ..... 237/19

* cited by examiner

*Primary Examiner*—William Doerrler
*Assistant Examiner*—Chen-Wen Jiang
(74) *Attorney, Agent, or Firm*—Rodgers & Rodgers

(57) ABSTRACT

A dehumidifier comprising hot and cold water supply pipes interconnected to a showerhead in a bathroom, a hot heat exchanger interconnected to the hot water supply pipe, fan means to pull air from an adjacent room across the hot air exchanger and into the bathroom, and an exhaust fan to remove air from the bathroom

8 Claims, 2 Drawing Sheets

DEHUMIDIFIER

BACKGROUND OF THE INVENTION

This invention concerns dehumidifiers for use especially in connection with bathrooms and the like. It is well known that when an individual is taking a shower, a great deal of water vapor accumulates and condenses on the various surfaces of the bathroom. Most bathrooms have exhaust fans for removing the undesirable humid air; but, exhaust fans simply exhaust moist air from the room and replace it with air from an adjacent room. Since bathroom doors are customarily closed, it is inefficient and difficult for an exhaust fan to pull air from an adjacent room. If the door is left open, the exhaust fan might become effective but air from an adjacent room is typically undesirably cold.

Besides exhaust fans, dehumidification is accomplished by the use of a dehumidifier or refrigeration system wherein the evaporator acts as a cold surface on which moisture condenses and the condenser acts as a heat exchanger to rewarm the air before it passes back into the room. Such dehumidifiers are typically too large to fit conveniently in a typical bathroom.

SUMMARY OF THE INVENTION

By this invention, dehumidification in a bathroom is accomplished when air from an adjacent room enters the device and is selectively directed into contact with a heat exchanger and then forced into the bathroom by fan means.

DESCRIPTION OF THE PREFERRED EMBODIMENT

Figure 1:
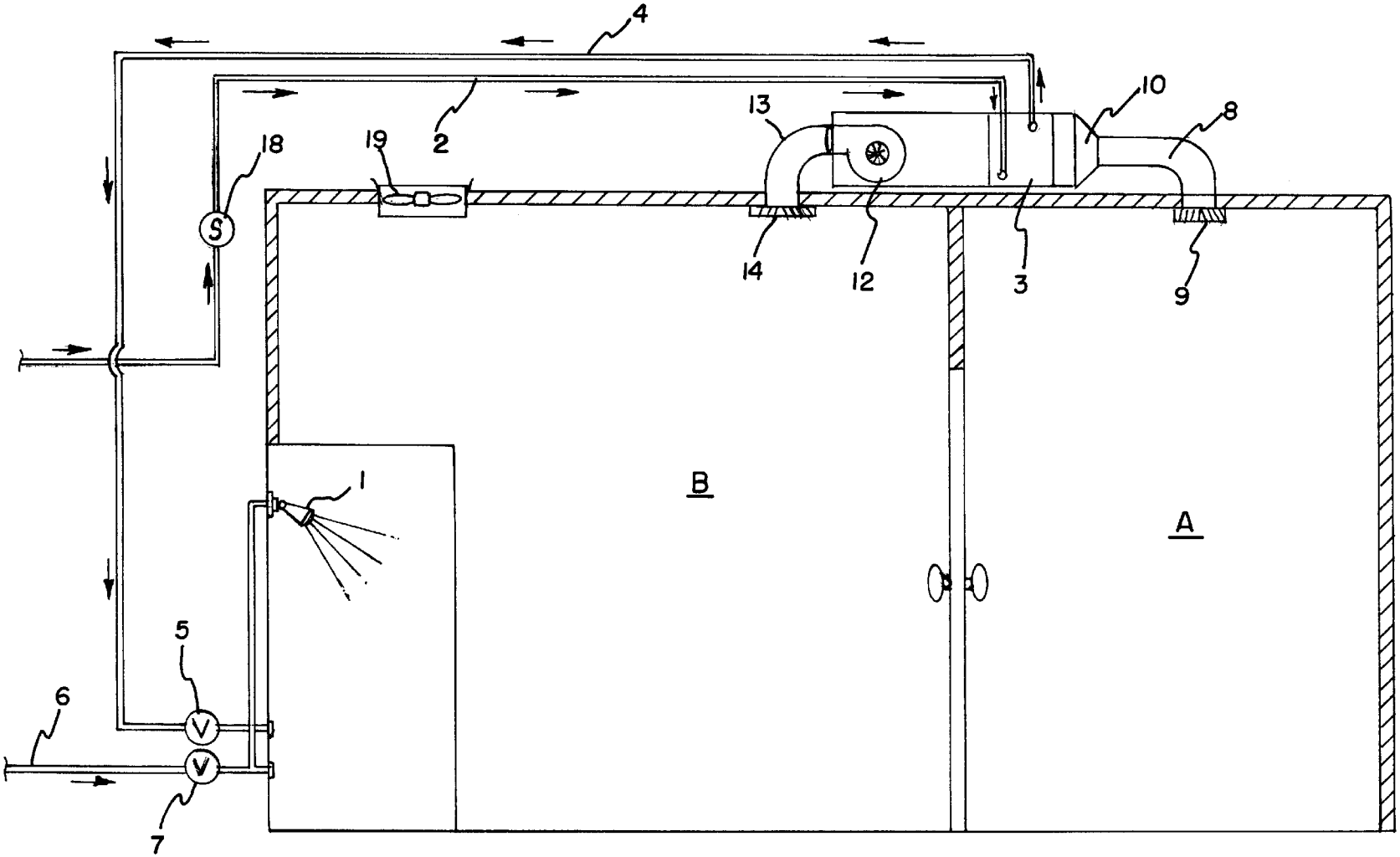
FIG. 1 is a schematic representation of a dehumidifying system according to this invention.

In the drawings, with particular reference to FIG. 1, the numeral 1 designates a conventional shower head. Hot water is supplied initially through pipe 2 whereby it enters dehumidifier 3 and then exits dehumidifier 3 through pipe 4 whereby it is directed to shower head 1. The flow of hot water is controlled by means of valve 5 as is well known. Cold water is supplied directly to shower head 1 by means of pipe 6 and is controlled by valve 7 also as is well known.

Figure 2:
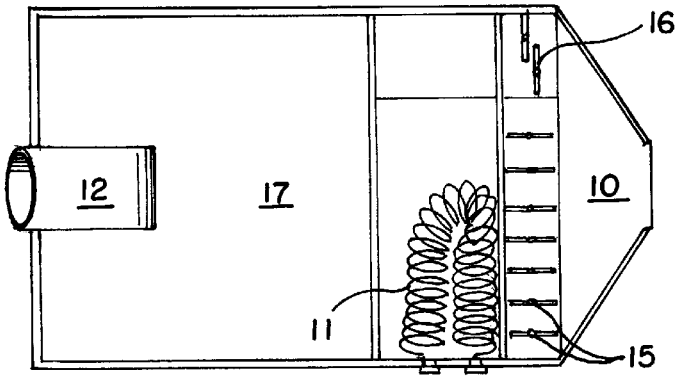
FIG. 2 is a top plan view showing the interior of the dehumidifier.
Figure 3:
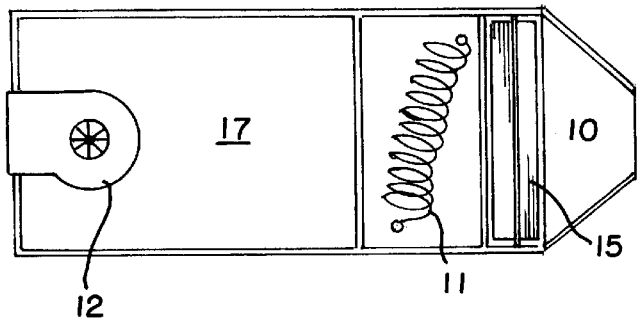
FIG. 3 is a side elevational view showing the interior of the dehumidifier.
Figure 4:
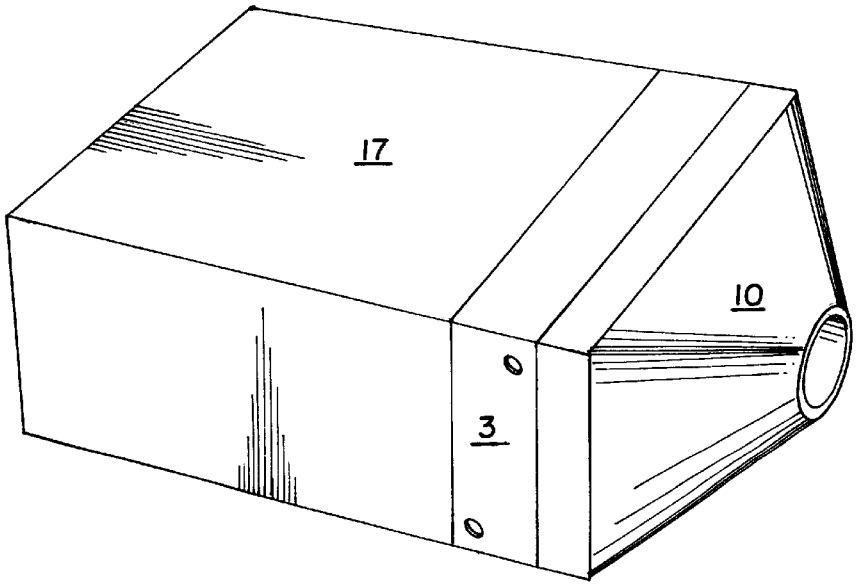
FIG. 4 is a perspective view showing the dehumidifier in accordance with this invention.

With the door to bathroom B shut and the bathroom thereby effectively sealed off from adjacent rooms, air from adjacent room A enters duct 8 through inlet 9. Air from adjacent room A then enters inlet plenum 10 by which it is directed to dehumidifier 3. More specifically and as best shown in FIG. 2, dehumidifier 3 comprises a heat exchanger in the form of hot water coil 11 which is heated by means of hot water entering through pipe 2 and then exiting through pipe 4. Air from adjacent room A is pulled through duct 8 and through hot water coil 11 by means of fan 12 which then directs the heated air through duct 13 and out through outlet grill 14 into bathroom B. To simplify the device, duct 13 can be eliminated with the air from dehumidifier 3 forced directly to bathroom B. Of course, dehumidifier 3 could comprise an electric heater thereby eliminating the need for the hot water connection.

According to one feature of this invention, the device is provided with heating damper 15 and bypass damper 16. Dampers 15 and 16 are either manually or thermostatically operable, as is well known, to provide the optimum temperature of the air flowing from adjacent room A. As is shown in FIG. 2, bypass damper 16 is in its fully closed position and heating damper 15 is fully open. By this means, all the air entering inlet plenum 10 is directed through hot water coil 11 and into fan section 17 whereby it is forced by means of fan 12 ultimately into bathroom B.

Of course, if heating damper 15 is closed and bypass damper 16 is fully open, none of the air entering inlet plenum 10 will be heated and room temperature air from adjacent room A will be forced into bathroom B. By setting damper 15 and 16 to intermediate positions, air temperature is achieved as desired between being fully heated and at room temperature.

According to another feature of this invention, the device is provided with sensor 18 which acts to sense movement of hot water through pipe 2 which in turn causes the simultaneous activation of fan 12 and exhaust fan 19 in a conventional manner. Of course, besides a waterflow switch, the device can be controlled by any well known means such as a humidistat, temperature sensor and the like. Also the device can be activated by means of a direct electrical connection to exhaust fan 19.

Therefore, by this invention, dehumidification is provided by utilizing room temperature air from an adjacent room and, if desired, heating it by means of hot water coil 11. As humid air is exhausted out of the bathroom by means of exhaust fan 19, the bathroom air is replaced with dry air from an adjacent room. The user is able to conveniently control the desired temperature of the air in the bathroom by the variable activation or deactivation of respective dampers 15 and 16.

Although the drawings show this invention for use primarily in connection with a bathroom environment, it is readily apparent that this invention is well suited for other environments where hot water is present such as kitchens, laundry rooms and the like.

What is claimed is:

1. A dehumidifier in combination with a first room having moisture in the air and another room, said dehumidifier comprising a cold water supply to said first room, a hot water supply pipe for supplying hot water to said first room, a heat exchanger, fan means for moving air in said another room through said heat exchanger and into said first room, and sensor means interconnected to said hot water pipe to sense movement of hot water in said hot water supply pipe.

2. A dehumidifier according to claim 1 wherein said heat exchanger comprises damper means for selectively directing the air from said another room through said heat exchanger.

3. A dehumidifier according to claim 2 wherein said damper means is manually operable.

4. A dehumidifier according to claim 2 wherein said damper means comprises a heating damper and a bypass damper.

5. A dehumidifier according to claim 1 wherein said heat exchanger comprises electric heating means.

6. A dehumidifier according to claim 1 wherein said hot heat exchanger is connected to said hot water supply pipe.

7. A dehumidifier in combination with a first room having moisture in the air and another room, said dehumidifier comprising a cold water supply to said first room, a hot water supply pipe for supplying hot water to said first room, a heat exchanger comprising damper means for selectively directing the air from said another room through said heat exchanger, fan means for moving air in said another room through said heat exchanger and into said first room, and said damper means comprising a heating damper and a bypass damper.

8. A dehumidifier according to claim 7 wherein sensor means is interconnected to said hot water pipe to sense movement of hot water in said hot water supply pipe.

* * * * *